US005138393A

United States Patent [19]

Okamura et al.

[11] Patent Number: 5,138,393

[45] Date of Patent: Aug. 11, 1992

[54] MAGNETIC CORE

[75] Inventors: Masami Okamura; Takao Sawa; Takao Kusaka; Yoshiyuki Yamauchi, all of Yokohama, Japan

[73] Assignee: Kabushiki Kaisha Toshiba, Kawasaki, Japan

[21] Appl. No.: 533,777

[22] Filed: Jun. 6, 1990

[30] Foreign Application Priority Data

Jun. 8, 1989 [JP] Japan ..... 1-144101

[51] Int. Cl.[5] ..... H01F 3/00

[52] U.S. Cl. ..... 335/297; 336/213; 336/219

[58] Field of Search ..... 335/297, 296; 336/213, 336/219, 218, 233, 234; 307/106, 415

[56] References Cited

U.S. PATENT DOCUMENTS

| | | | |
|---|---|---|---|
| 4,364,020 | 12/1982 | Lin | 336/219 |
| 4,368,447 | 1/1983 | Inomata | 336/213 |
| 4,558,297 | 12/1985 | Shigeta | 336/213 |
| 4,587,507 | 5/1986 | Takayama | 336/213 |
| 4,871,925 | 10/1989 | Yamauchi | 307/415 |
| 4,928,020 | 5/1990 | Birx | 306/415 |

OTHER PUBLICATIONS

"An All Solid-State Magnetic Switching Exciter for Pumping Excimer Lasers", Tsutome Simada et al., Ray. Scl. Instrum. 56 (11), Nov. 1985.

"Metallic Glasses for Magnetic Switches", Allied Corporation Metglas Products, IEEE Conf. Record of 15th Power Modulator Symposium held: Jun. 14–16, 1982, Baltimore.

*Primary Examiner*—Leo P. Picard
*Assistant Examiner*—Trinidad Korka
*Attorney, Agent, or Firm*—Oblon, Spivak, McClelland, Maier & Neustadt

[57] ABSTRACT

A magnetic core comprises at least one layer of magnetic film composed of an amorphous alloy and an electrically insulating film made of polyimide. Powder materials having a property for alleviating mutual influence between the magnetic thin film and the insulating film during a heat treatment thereof are stuck to a surface of the magnetic film or the insulating film. The magnetic film and the electrically insulating film are alternately wound up in a predetermined shape with powder material interposed therebetween to thereby form a magnetic core.

19 Claims, 1 Drawing Sheet

MAGNETIC CORE

BACKGROUND OF THE INVENTION

The present invention relates to a magnetic core and, more particularly, to a high power pulse magnetic core such as saturable core impulse source for lasers as an induction core for a linear accelerator.

Generally, a high power pulse magnetic core, for example an induction core of a linear accelerator, operates essentially as a 1:1 transformer and accelerates the beam of charged particles in the center of the core by a voltage which appears across a gap.

Recently, there has been proposed a pulse source adapted for lasers of the type of a magnetic pulse compressor which operates with high power and high voltage. The pulse compressor serves to convert a pulse generated by the power source having a wide pulse width into a high power pulse having a relatively narrow pulse width. This conversion is achieved by utilizing a saturation phenomenon of the magnetic core incorporated in the pulse compressor.

In a conventional technology, the magnetic core for the high power pulse generation is made of a material having a high saturation magnetic flux density and a high rectangular ratio of a magnetization curve. For this purpose, a magnetic core is formed by alternately laminating or winding a thin metallic film made of an iron based amorphous alloy or cobalt based amorphous alloy and an electrically insulating film made of a polymeric film such as polyimide film.

The magnetic core formed by alternately laminating or winding the polymeric film such as the polyimide film as the insulating layer and the magnetic film is then thermally heated. However, the polymeric film is liably subjected to heat shrinkage by such heat treatment and, hence, the heat shrinkage adversely affects the magnetic film to apply compression stress, resulting in the lowering of the rectangular ratio of the magnetization curve and degrading the magnetic characteristic of the magnetic core.

SUMMARY OF THE INVENTION

An object of the present invention is to substantially eliminate the defects or drawbacks encountered in the prior technology described above and to provide a magnetic core having a high rectangular ratio of the magnetization curve even after the heat treatment of the magnetic core and having an improved magnetic characteristic.

This and other objects can be achieved according to one aspect of present invention by providing a magnetic core comprising at least one layer of magnetic film, an electrically insulating film, and a substance interposed between the magnetic film and the electrically insulating film and having a property for alleviating mutual influence between the magnetic film and the insulating film during a heat treatment thereof, the magnetic film and the electrically insulating film being alternately wound in a predetermined shape with the substance interposed therebetween.

In a preferred embodiment, the magnetic film is made of an amorphous alloy and the electrically insulating film is made of a polyimide. The substance is composed of powder material of such as oxide, nitrate or carbonate of magnesium, silicon or the like.

In another aspect of the present invention, the magnetic film and the electrically insulating film, both in the shape of disc, for example, are laminated alternately with a substance having a property for alleviating mutual influence between the magnetic film and the electrically insulating film such as powder materials interposed therebetween.

According to the magnetic core having the characteristics described above, the substance, such as powder materials, having a property for alleviating the mutual influence between the magnetic film, preferably of the amorphous alloy, and an electrically insulating film, such as polyimide film, is interposed therebetween. The magnetic film and the electrically insulating film are alternately wound up with the powder materials interposed therebetween to form a magnetic core. Accordingly, the magnetic core has a high rectangular ratio of the magnetization curve after the heat treatment.

DESCRIPTION OF THE PREFERRED EMBODIMENTS

Figure 1:
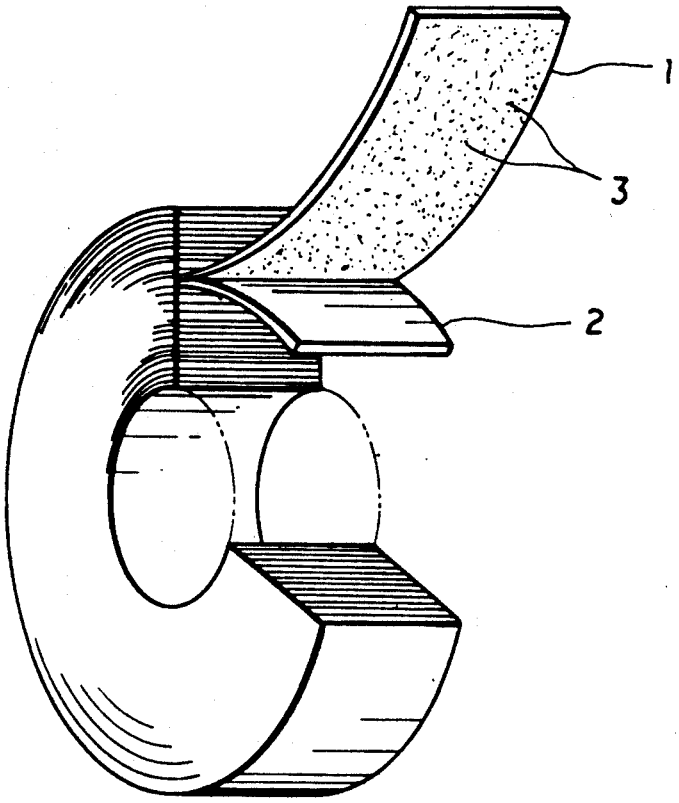
FIG. 1 is a perspective view, partially broken away, of one embodiment of a magnetic core according to the present invention.

FIG. 1 shows a perspective view, partially broken away for showing a wound-up condition of layers, of a magnetic core prepared in accordance with one embodiment of the present invention, in which a magnetic film layer 1 and an electrically insulating film layer 2, both described in detail hereinafter by way of preferred examples, are wound up around a core rod or mandrel. A material or substance 3, such as powders, is stick to the surface of the magnetic film 1 or the insulating film 2 in the manner described herein later.

As described, for example, with reference to FIG. 1, the material 3 is stick to the magnetic film 1 and, accordingly, the material will be referred to as a material interposed between the films 1 and 2, i.e., an interposed material, herein for the sake of convenience.

According to the present invention, the material or substance for forming the magnetic film is not limited to a specific one, but it is preferred to utilize an iron based amorphous alloy ribbon, a cobalt based amorphous alloy ribbon or a crystalline iron based magnetic alloy film with an ultrafine grain structure precipitated by crystallization of the amorphous state.

The crystalline iron based magnetic alloys have the composition represented by formula:

$$(Fe_{1-g}N_g)_{100-H-i-j-k-l-m}Cu_h Si_i B_j N'_k N''_l Z_m$$

wherein N represents at least one selected from the group consisting of Co and Ni; N'represents at least one selected from the group consisting of Nb, W, Ta, Zr, Hf, Ti and Mo; N'' represents at least one selected from the group consisting of V, Cr, Mn, Al, elements in the platinum group, Sc, Y, rare earth elements, Au, Zn, Sn, and Re; Z represents at least one selected from the group consisting of C, Ge, P, Ga, Sb, In, Be and As; and g, h, i, j, k, l, m represent numbers satisfying $0 \leqq g \leqq 0.5$, $0.1 \leqq h \leqq 3$, $0 \leqq i \leqq 30$, $0 \leqq j \leqq 25$, $23\ i+j \leqq 35$, $0,1 \leqq k \leqq 30$, $0 \leqq 1 \leqq 10$ and $0 \leqq m \leqq 10$; at least 50% of alloy structure being ultrafine grain having an average grain size of less than 500 Å.

The iron based amorphous alloy has the composition represented by the formula:

$$(Fe_{1-a-b}M_aM'_b)_{100-c}Y_c$$

wherein M represents at least one selected from the group consisting of Co and Ni; M' represents at least one selected from the group consisting of Ti, V, Cr, Mn, Cu, Zr, Nb, Mo, Ta, and W; Y represents at least one selected from the group consisting of B, Si, C and P; and a, b, and c represent numbers satisfying $0 \leqq a \leqq 0.4$; $0 \leqq b \leqq 0.15$ and $14 \leqq c \leqq 25$, respectively.

The cobalt based amorphous alloys have the composition represented by the formula :

$$(Co_{1-c-d}Fe_cM''_d)_{100-f}(Si_{1-e}B_e)_f$$

wherein M'' represents at least one selected from the group consisting of V, Cr, Mn, Ni, Cu, Nb, and Mo; and c, d, e and f represent numbers satisfying $0.01 \leqq c \leqq 0.10$, $0 \leqq d \leqq 0.10$, $0.2 \leqq e \leqq 0.9$ and $20 \leqq f \leqq 30$, respectively. Such ribbon may be easily produced by rapid quenching from the melt, for example, to an alloy having predetermined metal composition. It is preferred, but not limitatively, for the film to have a thickness of less than 40 μm, and more specifically, to have a thickness from 12 to 30 μm.

The interposed material 3, in FIG. 1, for example, is not limited to a specific material as long as the material has a property withstanding against heating during the heat treatment. However, it may be preferred for the interposed material to be formed from a material having an electrically insulating property for further ensuring the insulation between the laminated magnetic films. Furthermore, in consideration of the workability or handling efficiency of the interposed material when the interposed material is inserted between the magnetic film and the insulating film, powder materials may be preferred for the interposed material.

As a method or process of interposing the powder material between the magnetic film and the insulating film, a powder sticking method in which the powder materials are stuck to the surface of the insulating film or magnetic film will be preferably utilized for easy and simple operation efficiency.

The following methods will be referred to for sticking the powder materials on the surface of the magnetic thin metal film, for example:

1. A method in which powders are dispersed in water to form a suspension into which the magnetic film is immersed;

2. A method utilizing an electrophoresis treatment; and

3. A method in which powders are sprayed on the surface of the magnetic film by spraying means.

However, as these methods are themselves per se known, the explanation thereof are omitted herein.

With the powder sticking methods described above, it is possible to stick the powder material on one or both surfaces of the magnetic film, but the objects and effects of the present invention can be more effectively achieved by sticking the powder materials on both the surfaces of the magnetic film for the reason that, when the magnetic film and the insulating film are wound up for forming a magnetic core, the insulating films between which one magnetic film is interposed less affects the interposed magnetic film.

The electrically insulating film is no specifically limited in the material thereof, but it is found that the usage of the polyimide film, which is thermally shrunk at a high temperature, attains suitable effect, and the magnetic core will attain more remarkable effect in combination of the polyimide film and the iron based amorphous film having relatively large magnetostriction.

The powder materials to be stuck are not specifically limited in the substance thereof, but powders having the electrically insulating property such as at least one selected from oxide, nitrate or carbonate of at least one selected from magnesium, silicon, aluminium, zirconium or titanium may be preferred and, particularly, the magnesium, silicon or aluminium oxide may be most preferred for the reason that these oxides can easily be handled and obtained with relatively low cost.

Furthermore, according to the present invention, there is no limitation to the grain size of the powder, but it may be preferred for the grain to have a diameter (which herein means the diameter of the smallest ball including powder) of 0.05 to 40 μm. This is because the objects and effects of the present invention are hardly achieved when the grain diameter is too small and, on the other hand, when the grain diameter is too large, a magnetic substance space factor is extremely lowered upon manufacturing the magnetic core from the magnetic film. In consideration of these facts, it is preferred for the grain of the powder to have a diameter of 0.5 to 10 μm.

One method of concretely producing the magnetic core, for example as shown in FIG. 1, according to the present invention will be described hereunder.

A magnetic film and an electrically insulating film are preliminarily prepared and powder materials, preferably having an electrically insulating property, are stuck by, for example, dispersing the powder materials into water to form a suspension, immersing at least one of the magnetic film and the insulating film and then drying the immersed one. The thus prepared magnetic film and the insulating film are alternately wound up around a reel or mandrel, for example, in a state such as shown in FIG. 1, in which the powder materials are stuck to the surface of the magnetic film 1. The magnetic core is then finally produced by heat treatment of the thus wound-up core. The magnetization characteristic such as the rectangular ratio of the produced magnetic core will be improved by carrying out the heat treatment in a D.C. or A.C. magnetic field. In such heat treatment, it is preferred that the magnetic field have an intensity of about 0.5 to 100 Oe (oersted), preferably of about 2 to 20 Oe.

The combination of the magnetic film and the electrically insulating film may be optionally selected according to the present invention in accordance with the characteristics of the product magnetic core required. For example, more than two insulating film layers are wound up in the case where strong electric insulation is required and, on the other hand, more than two magnetic thin metal film layers are wound up in the case where the strong magnetized characteristic is required.

Concrete examples of the present invention will be described hereunder in comparison with comparative examples.

EXAMPLE 1

An amorphous ribbon having a composition of $Fe_{78}Si_9B_{13}$ (at %) and having a thickness of 22 μm was immersed in a suspension which was prepared by diffusing magnesium oxide (MgO) powders (1 wt. %) into water to thereby stick the powders on the surface of the amorphous ribbon. The immersed amorphous ribbon was thereafter put in an electric furnace and heated to a temperature of about 150° to dry the same. The thus prepared amorphous ribbon and a polyimide film (Commercial Name: UPILEX, produced by UBE KOSAN, Thickness: 5 μm) were alternately wound up a magnetic core having an outer diameter of 50 mm, inner diameter of 30 mm and a height of 13 mm. The thus formed magnetic core was then heat treated for two hours at a constant temperature of 380° in a D.C. constant magnetic field of 10 Oe.

COMPARATIVE EXAMPLE 1

A magnetic core was prepared and formed by substantially the same manner as that described with reference to the Example 1 except that no powder was stuck to the amorphous ribbon.

EXAMPLE 2

An amorphous ribbon having a composition of $Fe_{78}Si_9B_{13}$ (at %) and having a thickness of 22 μm was immersed in a dispersion solution which was prepared by diffusing magnesium oxide (MgO) powders (1 wt. %) into water to thereby stick the powders on the surface of the amorphous ribbon. The immersed amorphous ribbon was thereafter put in an electric furnace and heated to a temperature of about 150° to dry the same. The thus prepared two amorphous ribbons and one amorphous ribbon on which the MgO powders were not stuck were laminated in a sandwiched manner to form three amorphous alloy ribbon layer. The amorphous ribbon layers and one polyimide film having a thickness of 7.5 μm were then wound up around a magnetic core having an outer diameter of 50 mm, inner diameter of 30 mm and a height of 13 mm. The thus formed magnetic core was then heat treated for two hours at a constant temperature of 380° in a D.C. constant magnetic field of 10 Oe.

COMPARATIVE EXAMPLE 2

A magnetic core was prepared and formed by substantially the same manner as that described with reference to the Example 2 except that no powder was stuck to the amorphous alloy ribbon.

EXAMPLE 3

An amorphous alloy ribbon having a composition of $(Co_{0.94}Fe_{0.06})_{70}Ni_3Nb_1Si_{11}B_{15}$ (at %) and having a thickness of 16 μm was immersed in a dispersion solution which was prepared by diffusing magnesium oxide (MgO) powders (1 wt. %) into water to thereby stick the powders on the surface of the amorphous alloy ribbon. The immersed amorphous alloy ribbon was thereafter put in an electric furnace and heated to a temperature of about 150° to dry the same. The thus prepared amorphous alloy ribbon and a polyimide film having a thickness of 7.5 μm were alternately wound up around a magnetic core having an outer diameter of 50 mm, inner diameter of 30 mm and a height of 13 mm. The thus formed magnetic core was then heat treated for one hour at a constant temperature of 420° in a D.C. constant magnetic field of 10 Oe.

COMPARATIVE EXAMPLE 3

A magnetic core was prepared and formed by substantially the same manner as that described with reference to Example 3 except that no powder was stuck to the amorphous alloy ribbon.

EXAMPLE 4

An amorphous alloy ribbon having a composition of $Fe_{81}Si_{3.5}B_{13.5}C_2$ (at %) and having a thickness of 22 μm was immersed in a dispersion solution which was prepared by diffusing magnesium oxide (MgO) powders (1 wt. %) into water to thereby stick the powders on the surface of the amorphous alloy ribbon. The immersed amorphous ribbon was thereafter put in an electric furnace and heated to a temperature of about 150° to dry the same. The thus prepared amorphous alloy ribbon and a polyimide film having a thickness of 7.5 μm were alternately wound up around a magnetic core having an outer diameter of 50 mm, inner diameter of 30 mm and a height of 13 mm. The thus formed magnetic core was then heat treated for two hours at a constant temperature of 360° in a D.C. constant magnetic field of 10 Oe.

COMPARATIVE EXAMPLE 4

A magnetic core was prepared and formed by substantially the same manner as that described with reference to the Example 4 except that no powder was stuck to the amorphous alloy ribbon.

EXAMPLE 5

An amorphous alloy ribbon having a composition of $Fe_{67}Co_{18}Si_1B_{14}$ (at %) and having a thickness of 22 μm was immersed in a dispersion solution which was prepared by diffusing magnesium oxide (MgO) powders (1 wt. %) into water to thereby stick the powders on the surface of the amorphous alloy ribbon. The immersed amorphous ribbon was thereafter put in an electric furnace and heated to a temperature of about 150° to dry the same. The thus prepared amorphous alloy ribbon and a polyimide film having a thickness of 7.5 μm were alternately wound up around a magnetic core having an outer diameter of 50 mm, inner diameter of 30 mm and a height of 13 mm. The thus formed magnetic core was then heat treated for two hours at a constant temperature of 320° in a D.C. constant magnetic field of 10 Oe.

COMPARATIVE EXAMPLE 5

A magnetic core was prepared and formed by substantially the same manner as that described with reference to the Example 5 except that no powder was stuck to the amorphous alloy ribbon.

EXAMPLE 6

An amorphous alloy thin film having a composition of $Fe_{78}Si_9B_{13}$ (at %) and having a thickness of 22 μm was immersed in a dispersion solution which was prepared by diffusing silicon dioxide ($SiO_2$) powders (1 wt. %) into water to thereby stick the powders on the surface of the amorphous alloy ribbon. The immersed amorphous ribbon was thereafter put in an electric furnace and heated to a temperature of about 150° to dry the same. The thus prepared amorphous alloy ribbon and a polyimide film having a thickness of 7.5 μm were alternately wound up around a magnetic core having an outer diameter of 50 mm, inner diameter of 30 mm and a height of 13 mm. The thus formed magnetic core was then heat treated for two hours at a constant temperature of 380° in a D.C. constant magnetic field of 10 Oe.

COMPARATIVE EXAMPLE 6

A magnetic core was prepared and formed by substantially the same manner as that described with reference to the Example 6 except that no powder was stuck to the amorphous alloy ribbon.

With respect to the thus prepared twelve magnetic cores, rectangular ratios of the magnetization curves, maximum magnetic flux densities, coercive forces and magnetic flux densitie swing were examined under the condition of a constant temperature. The rectangular ratios, the maximum magnetic flux densities and the corecive forces were measured by a D.C. automatic hysteresis loop tracer at an applied field of 10 Oe. The magnetic flux density swing ($\Delta B$) was $\Delta B = Br + Bm$.

The results of the measurements are summarized in the following Table 1.

TABLE 1

| | Amorphous Alloy Composition (at %) | Electrically insulating Powder | Rectangular Ratio (Br/Bm) | Maximum magnetic Flux Density (Bm(kG)) | Coercive Force (Hc(Oe)) | Magnetic Flux Density Swing ($\Delta B$(kG) |
|---|---|---|---|---|---|---|
| Example 1 | $Fe_{78}$ $Si_9$ $B_{13}$ (Amorphous ribbon:Polyimide Film = 1:1) | MgO | 0.93 | 15.6 | 0.037 | 30.1 |
| Comparative Example 1 | $Fe_{78}$ $Si_9$ $B_{13}$ (Amorphous ribbon:Polyimide Film = 1:1) | No | 0.69 | 15.5 | 0.040 | 26.2 |
| Example 2 | $Fe_{78}$ $Si_9$ $B_{13}$ (Amorphous ribbon:Polyimide Film = 3:1) | MgO | 0.94 | 15.6 | 0.035 | 30.3 |
| Comparative Example 2 | $Fe_{78}$ $Si_9$ $B_{13}$ (Amorphous ribbon:Polyimide Film = 3:1) | No | 0.84 | 15.6 | 0.034 | 28.7 |
| Example 3 | $(Co_{0.94}$ $Fe_{0.06})$ $Ni_3$ $Nb_1$ $Si_{11}$ $B_{15}$ | MgO | 0.96 | 6.8 | 0.011 | 13.3 |
| Comparative Example 3 | $(Co_{0.94}$ $Fe_{0.06})$ $Ni_3$ $Nb_1$ $Si_{11}$ $B_{15}$ | No | 0.88 | 6.8 | 0.011 | 12.8 |
| Example 4 | $Fe_{81}$ $Si_{3.5}$ $B_{13.5}$ $C_2$ | MgO | 0.86 | 16.0 | 0.043 | 29.8 |
| Comparative Example 4 | $Fe_{81}$ $Si_{3.5}$ $B_{13.5}$ $C_2$ | No | 0.51 | 15.8 | 0.047 | 23.9 |
| Example 5 | $Fe_{67}$ $Co_{18}$ $Si_1$ $B_{14}$ | MgO | 0.89 | 18.0 | 0.056 | 34.0 |
| Comparative Example 5 | $Fe_{67}$ $Co_{18}$ $Si_1$ $B_{14}$ | No | 0.47 | 17.6 | 0.058 | 25.9 |
| Example 6 | $Fe_{78}$ $Si_9$ $B_{13}$ | $SiO_2$ | 0.92 | 15.6 | 0.040 | 30.0 |
| Comparative Example 6 | $Fe_{78}$ $Si_9$ $B_{13}$ | No | 0.63 | 15.6 | 0.041 | 25.4 |

Figure 2:
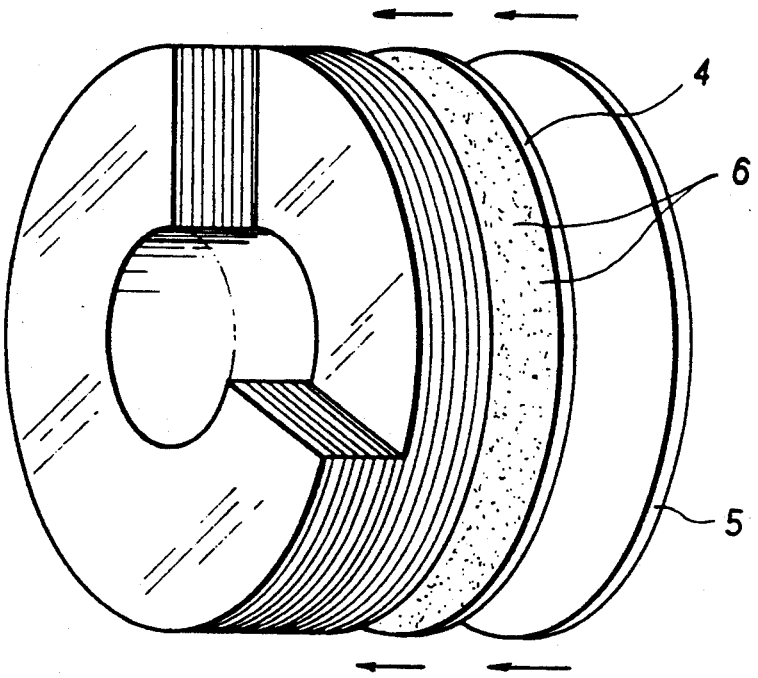
FIG. 2 is also a perspective view of another embodiment of a magnetic core according to the present invention.

FIG. 2 shows a perspective view of a magnetic core prepared in accordance with another embodiment of the present invention, in which the magnetic core is prepared by alternately laminating magnetic film layers 4 and electrically insulating film layers 5. These magnetic film layers 4 and insulating film layers 5 are generally formed by punching a thin magnetic metal plate and a thin insulating plate in the shape of discs, for example, and such discs are laminated alternately as shown. According to the present invention, a material or substance 6, such as powders, is stuck to the surface of the magnetic film layers 4 or the insulating film layers 5.

In the practical production of the magnetic core, however, it may be preferred to produce the magnetic core by winding the magnetic thin metal film and the insulating film around the mandrel, for example as shown in FIG. 1, in comparison with the magnetic core produced by alternately laminating these discs such as shown in FIG. 2, in consideration of the actual product and apparatus to be used.

What is claimed is:

1. A magnetic core comprising:

at least one layer of magnetic film;

an electrically insulating film; and a substance interposed between said magnetic film and said electrically insulating film and having a property for alleviating mutual influence between said magnetic film and said insulating film during a heat treatment thereof;

said magnetic film and said electrically insulating film being alternately wound in a predetermined shape with said substance interposed therebetween.

2. A magnetic core according to claim 1, wherein said magnetic film is composed of an iron based amorphous alloy.

3. A magnetic core according to claim 1, wherein said magnetic film is composed of a cobalt based amorphous alloy.

4. A magnetic core according to claim 1, wherein said magnetic film has a thickness of less than 40 μm.

5. A magnetic core according to claim 4, wherein said magnetic film has a thickness of 12 to 30 μm.

6. A magnetic core according to claim 1, wherein said electrically insulating film is made of a substance having a thermally shrinkable property.

7. A magnetic core according to claim 6, wherein said electrically insulating film is formed of a polyimide.

8. A magnetic core according to claim 1, wherein said substance interposed between said magnetic film and said electrically insulating film has an electrically insulating property.

9. A magnetic core according to claim 1, wherein said magnetic film is composed of three laminated layers having an intermediate layer on which said substance is not disposed.

10. A magnetic core according to claim 1, wherein the heat treatment is performed in a magnetic field having an intensity of 0.5 to 100, preferably 2 to 20, oersted.

11. A magnetic core comprising:

at least one layer of magnetic film composed of an amorphous alloy;

an electrically insulating film made of polyimide film; and powder materials stuck to a surface of said magnetic film and having a property for alleviating mutual influence between said magnetic film and said insulating film during a heat treatment thereof;

said magnetic film and said electrically insulating film being alternately wound up in a predetermined shape with said powder material interposed therebetween.

12. A magnetic core comprising:

at least one layer of magnetic film generally of a disc shape;

at least one layer of electrically insulating film generally of a disc shape; and a substance interposed between said magnetic film and said electrically insulating film and having a property for alleviating mutual influence between said magnetic thin film and said electrically insulating film during a heat treatment thereof;

said magnetic film and said electrically insulating film being alternately laminated with said substance interposed therebetween.

13. A magnetic core comprising:

at least one layer of magnetic film;

an electrically insulating film, wherein said at least one layer of magnetic film and said electrically insulating film are alternately wound in a predetermined shape; and a substance interposed between said at least one layer of magnetic film and said electrically insulating film and having a property for alleviating mutual influence between said magnetic film and said electrically insulating film during a heat treatment, said substance being formed of a powder material having an electrically insulating property selected from at least one of oxide, nitrate and carbonate.

14. A magnetic core according to claim 13, wherein said oxide, nitrate, or carbonate is at least one selected from oxide, nitrate or carbonate of magnesium, silicon, aluminium, zirconium or titanium.

15. A magnetic core according to claim 13, wherein said powder has a grain diameter of 0.005 to 40 μm.

16. A magnetic core according to claim 15, wherein said powder has a grain diameter of 0.5 to 10 μm.

17. A magnetic core according to claim 13, wherein said powder is stuck to a surface of said magnetic film.

18. A magnetic core according to claim 13, wherein said powder is stuck by immersing said magnetic thin film in a dispersing solution prepared by dispersing said powder in water.

19. A magnetic core according to claim 13, wherein said powder is stuck to a surface of said electrically insulating film.

* * * * *